US006655565B2

(12) United States Patent
Godshaw et al.

(10) Patent No.: US 6,655,565 B2
(45) Date of Patent: Dec. 2, 2003

(54) BACKPACK LUGGAGE WITH DUAL ACCESS ENTRY

(75) Inventors: Donald E. Godshaw, Evanston, IL (US); Andrezj M. Redzisz, Skokie, IL (US)

(73) Assignee: Travel Caddy, Inc., Des Plaines, IL (US)

( * ) Notice: Subject to any disclaimer, the term of this patent is extended or adjusted under 35 U.S.C. 154(b) by 0 days.

(21) Appl. No.: 09/821,208

(22) Filed: Mar. 29, 2001

(65) Prior Publication Data

US 2002/0139820 A1 Oct. 3, 2002

(51) Int. Cl.[7] ..... A45F 3/04

(52) U.S. Cl. ..... 224/653; 224/655; 224/576; 224/652; 224/657

(58) Field of Search ..... 224/653, 655, 224/657, 576, 652; 190/111

(56) References Cited

U.S. PATENT DOCUMENTS 3,869,034 A * 3/1975 Thornton, Jr. ..... 190/111
5,105,920 A * 4/1992 Grebenstein ..... 190/103
5,160,001 A * 11/1992 Marceau ..... 190/102
5,209,384 A * 5/1993 Anderson ..... 224/223
5,217,119 A * 6/1993 Hollingsworth ..... 190/102
5,228,547 A * 7/1993 Yoo ..... 190/103
5,407,112 A * 4/1995 Christodoulou et al. ..... 2/94
5,649,658 A * 7/1997 Hoffman et al. ..... 190/2
5,706,992 A * 1/1998 Moor ..... 190/102
5,819,998 A * 10/1998 Chehebar ..... 206/315.1
5,957,349 A * 9/1999 Krulik ..... 190/8
5,984,154 A * 11/1999 Scicluna ..... 190/18 A
6,059,079 A * 5/2000 Krulik ..... 190/111
6,193,118 B1 * 2/2001 Kearl ..... 108/43
6,230,952 B1 * 5/2001 Jupiter ..... 150/113

* cited by examiner

*Primary Examiner*—Stephen P. Garbe
(74) *Attorney, Agent, or Firm*—Banner & Witcoff

(57) ABSTRACT

A backpack comprises base, back, lateral side, top as well as first and second overlying front panels. The outside one of the front panels is congruent with the back panel. The other, interior front panel has a lesser height than the back panel thereby permitting ingress to the interior of the backpack through both the top as well as the front when the outside panel is released from attachment to the side and top panels.

11 Claims, 8 Drawing Sheets

BACKPACK LUGGAGE WITH DUAL ACCESS ENTRY

BACKGROUND OF THE INVENTION

In a principal aspect, the present invention relates to a backpack for carriage of various items and, more particularly, to a backpack having panels, flaps, and access openings which facilitate convenient use of the backpack.

Backpacks or knapsacks have become a common form of carriage of items by school children who use them for their books and papers, by hikers who use them for their gear, by business persons who use them for their personal computer, papers and materials, by picnic attendees who use them for their food and service and by others. Backpacks have replaced, in many instances, cases, valises and other types of luggage.

Typically, a backpack includes panels made from a fabric in the form of a generally rectangular parallelpiped bag with one of the panels being designated as the back panel that has straps attached for support of the backpack. Access to the interior of the backpack is afforded typically by openings with snap or zipper fasteners. Some backpacks include various pockets on sides of the backpack other than the backside. Some backpacks include a front panel which folds outwardly from the backpack to reveal the contents of the backpack. In other backpacks the front panel folds laterally or to one side to reveal the contents of a front storage compartment. Some backpacks have top access openings.

Though there are many designs for the construction of a backpack, there remains a need to provide unique, new, convenient versions of this very popular item of luggage. Among the needs is a backpack useful for carriage of infant care items including a changing pad. Further, an improved backpack for use by business persons for carriage of their computer and business papers is a desired item. Finally, a backpack for craftsman and laborers to enable them to easily carry their tools and work items is a desired item.

SUMMARY OF THE INVENTION

Briefly, the present invention comprises a backpack having a generally parallelpiped configuration with a back panel having straps affixed thereto and with a supplemental carry or tote handle also attached to the back panel. The backpack further includes a series of panels including a base panel, opposite or first and second lateral side panels, and a first front panel that collectively form an enclosure having the general shape of a parallelpiped with a top opening, although variations of this configuration are possible, including a trapezoidal shape of the assembled configuration. The front panel of the backpack has a reduced size and extends only partially upward from the base panel to define the open top enclosure for items and materials stored and retained within the backpack. A full-size second front panel or flap folds over the first front panel to enclose contents within the backpack. The second front panel provides a foldable cover which may be folded outwardly and downwardly from the backpack to reveal not only the contents retained in the space between the first front panel and the second front panel or flap, but also to provide access through the first front panel to the interior enclosure of the backpack. As a further means for access to the interior enclosure of the backpack, the backpack includes a top side panel or flap with an opening through the top and/or side panels. Alternatively, a removable flap extension of the backside may be provided to fit over or cover the interior enclosure.

In each embodiment, opening of the second front panel or flap and subsequent folding it downwardly and outwardly enables one to have access to substantially the entire interior of the backpack. Thus various embodiments of the backpack construction are disclosed including an embodiment which is especially useful for infant care and which includes an infant pad. Further, there is disclosed a business person's backpack as well as a tradesman's backpack useful for the carriage of tools.

Thus, it is an object of the invention to provide an improved backpack construction.

It is a further object of the invention to provide an improved backpack construction having a generally parallelpiped configuration or a generally trapezoidal profile wherein a front panel is foldable outwardly from the backpack to provide access to substantially the entire storage enclosure within the backpack even though the foldable front panel does not define a portion of the primary storage space within the backpack, but rather a first, separate foreshortened front panel, in combination with the other panels of the backpack provide the primary storage enclosure.

Yet another object of the invention is to provide a backpack construction which includes various auxiliary pockets on the front and sides of the backpack and which is designed to permit easy access to all of the storage pockets as well as the interior of the backpack.

A further object of the invention is to provide a backpack construction which may accommodate multiple uses including infant care, business needs, or transport and storage of tools.

These and other objects, advantages, and features of the invention will be set forth in the details of the description which follows.

BRIEF DESCRIPTION OF THE DRAWING

In the detailed description, which follows reference will be made to the drawing comprised of the following figures.

DESCRIPTION OF THE PREFERRED EMBODIMENT

Figure 11:
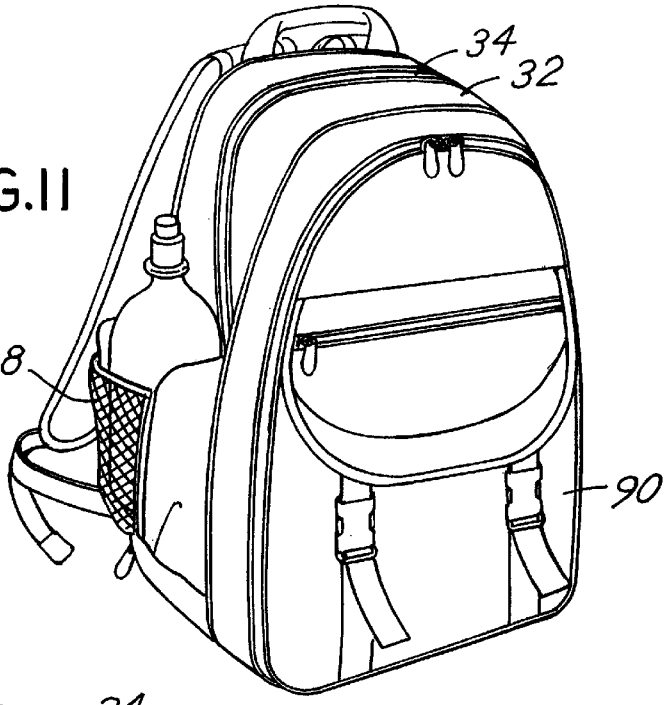
FIG. 11 is an isometric view of a second embodiment of the backpack of the invention adapted for business use and/or storage of a personal computer.
Figure 12:
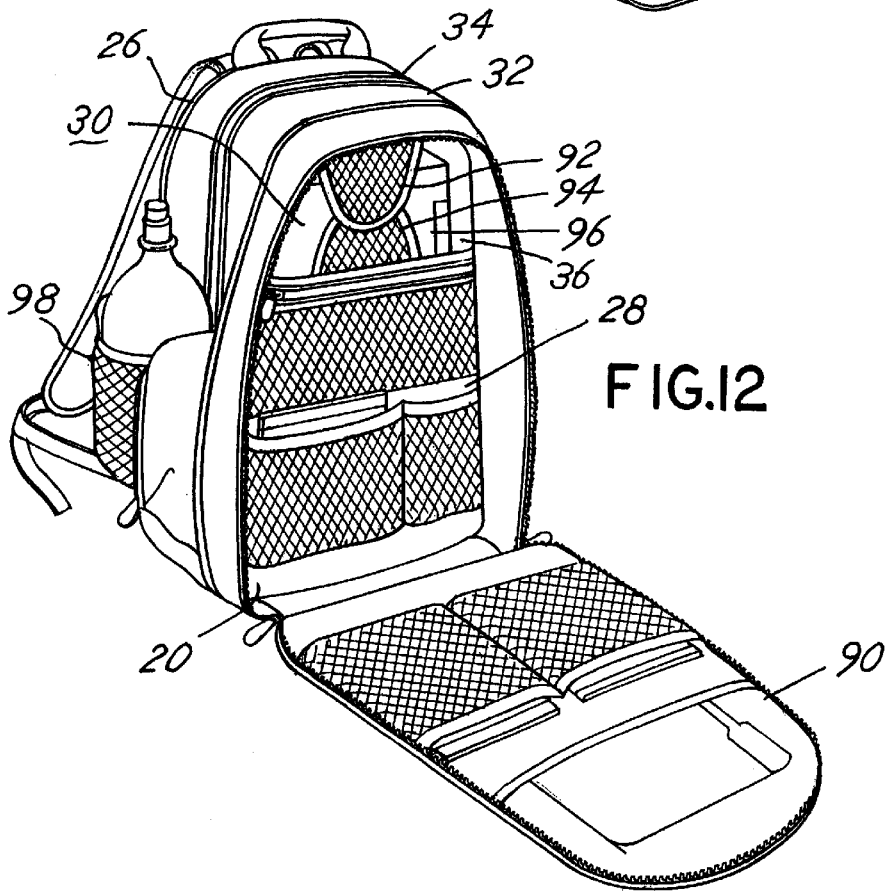
FIG. 12 is an isometric view of the backpack of FIG. 11 in the open position.
Figure 13:
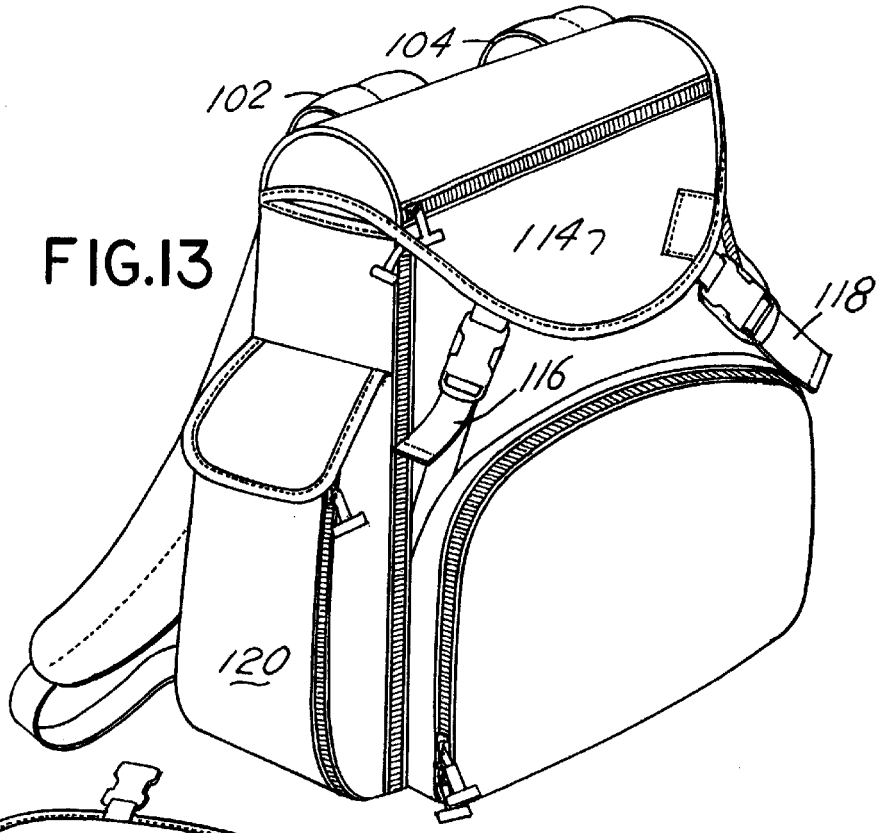
FIG. 13 is an isometric view of a third embodiment of the invention adapted for use by a tradesman or craftsman for carriage of tools.
Figure 14:
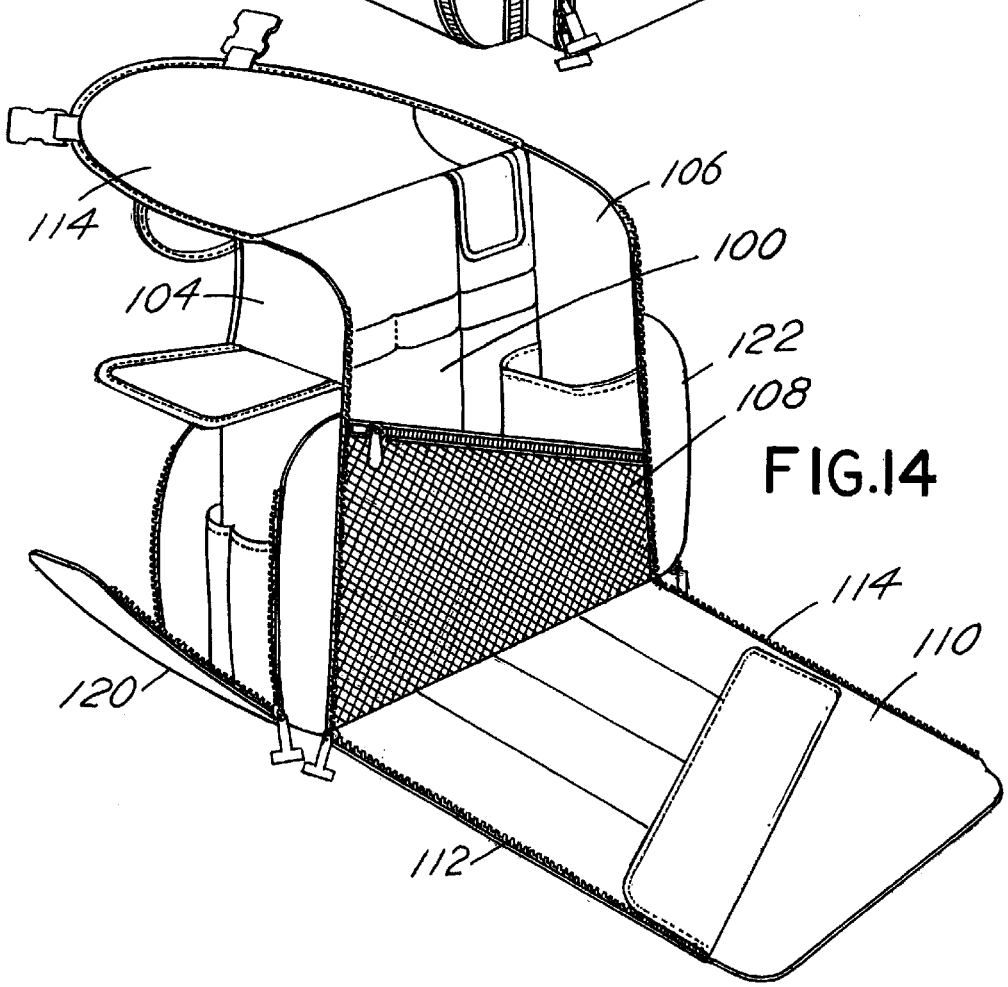
FIG. 14 is an isometric view of the backpack of FIG. 13 in the open position.

FIGS. 1 through 10 depict a first embodiment of the invention especially useful for infant care. FIGS. 11 and 12 depict a second embodiment especially designed for use by business persons or students. FIGS. 13 and 14 depict a third embodiment especially designed for use by tradesmen and craftsmen. There are features that are common to all three embodiments as discussed in further detail below. Thus like elements include like designations and numbering in the drawing. The backpack embodiments as depicted are especially useful for the described purposes though other uses and variations of the construction are possible without departing from the spirit and scope of the invention.

Referring to FIGS. 1–10, there is depicted a first embodiment of the invention. The backpack includes a bottom panel or base panel 20, a first lateral side panel 22, a second lateral side panel 24 spaced from first side panel 22, a backside panel 26, and a first, front-side panel 28. Panels 20, 22, 24, 26, and 28 define an enclosure space 30 accessible through an open top. In the first preferred embodiment of the invention the lateral side panels 22 and 24 fold over and connect through a top panel 32 defining a closed loop having a zipper opening 34 extending across the top 32 and partially down the side panels 22 and 24 to provide access to the enclosure space 30. The shape of the knapsack is thus generally a rectangular parallelapiped or alternatively a trapezoidal panel configuration for the back panel 26 and front side panel 28. Importantly the front panel 28 is not entirely congruent with the back panel 26. Rather, the front panel 28 encloses a lower portion or section of the enclosure 30 which extends from the base panel 20 partially upwardly. The sides of front panel 28 are connected to the opposite front side edges 23 and 25 of side panels 22 and 24. Front panel 28 extends upwardly from base panel 20 less than the full height of the backside 26. The backside panel 26 includes an upper portion 27 and a lower portion 29 congruent with the front panel 28. In this manner, in the embodiment shown in FIGS. 1–10, there is provided an access opening 36 to the interior enclosure 30 above the front panel 28 and the top edge 38 of the front panel 28. The front panel 28 may include a series of pockets, 40, sewn or attached thereto as well as a zipper accessible storage pocket 42.

The inside of the front panel 44 includes various pockets including a retention pocket 48 into which an infant support pad 50 is inserted and positioned by sliding into the pocket 48. An elastic retaining mesh 52 may assist in positioning pad 50. Additional storage pockets for flat items such as storage pockets 54 may be provided on the inside face of the second panel or flap 44.

The outer edge of the panel or flap 44 has a zipper 56 which enables attachment along the loop defined by lateral side edge of panel 22, the edge of top panel 32, and the lateral side edge of the panel 24 to provide for full attachment of the second front panel or second front panel flap 44 on to the backpack. Auxiliary pockets, such as pocket 58, may be provided and attached to lateral side 22. A second pocket 60 is attached to the lateral side 24. All of these pockets are optional.

Figure 1:
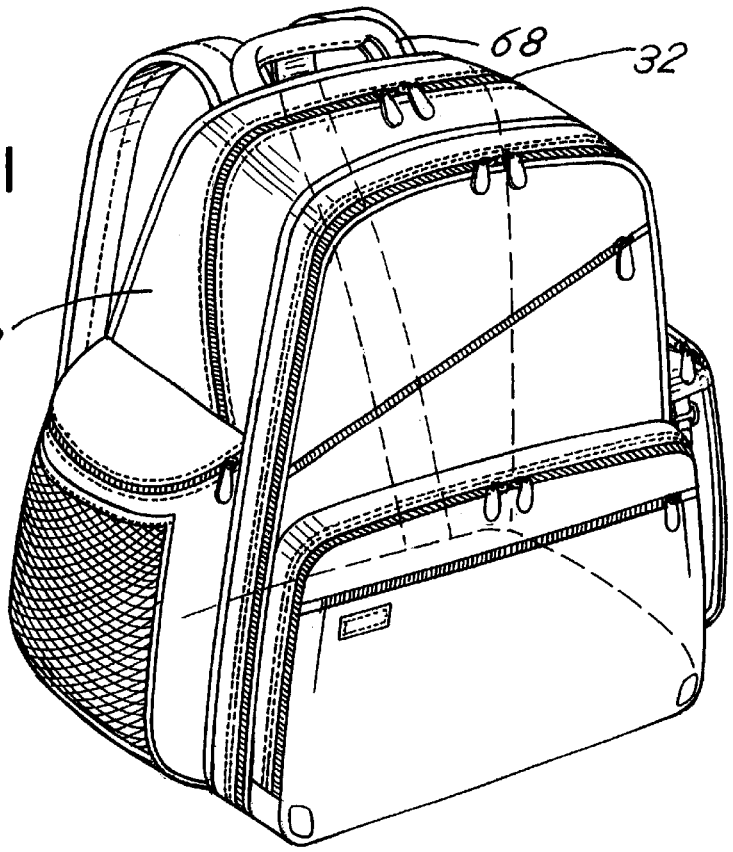
FIG. 1 is an isometric view of a first embodiment of the backpack of the invention wherein all of the flaps and panels are closed.
Figure 2:
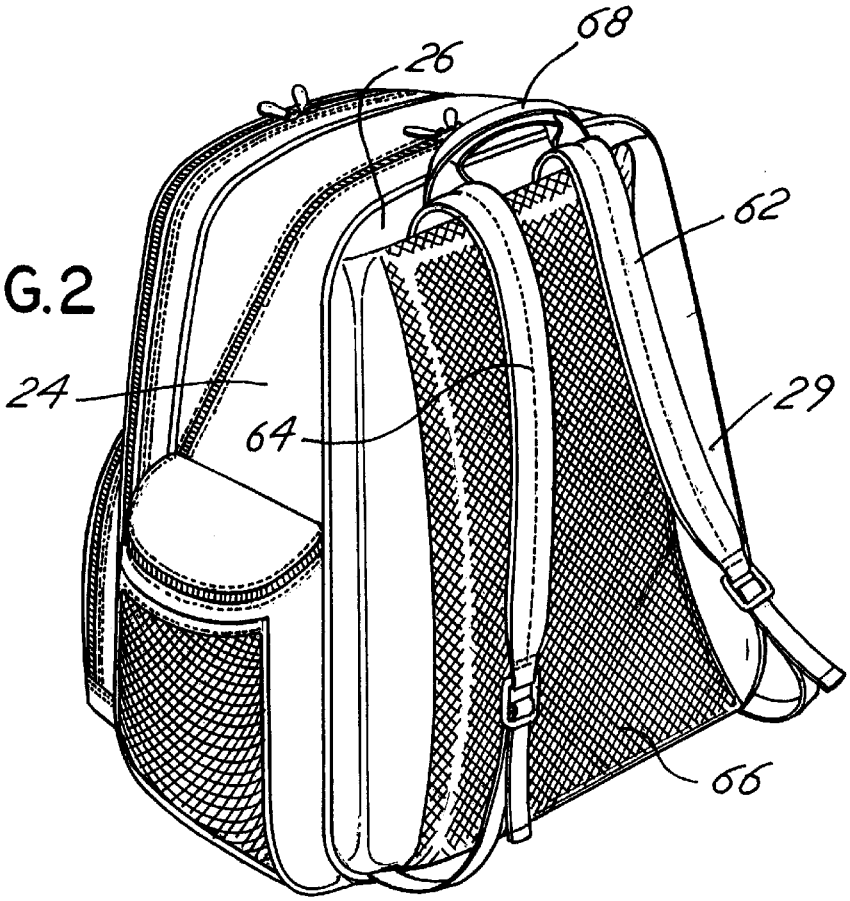
FIG. 2 is a backside isometric view of the backpack of FIG. 1.
Figure 3:
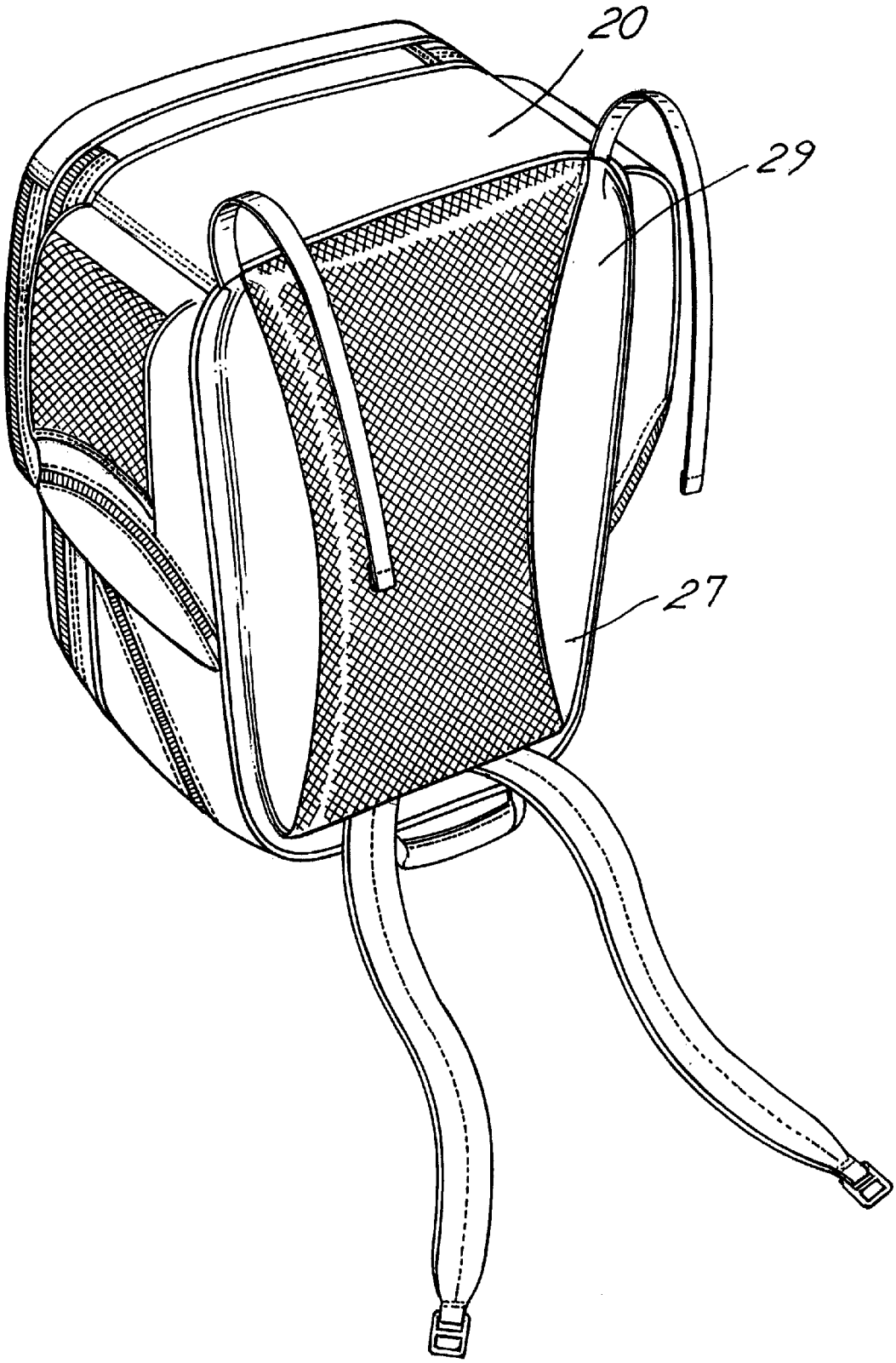
FIG. 3 is a back and bottom side isometric view of the backpack of FIG. 1.
Figure 4:
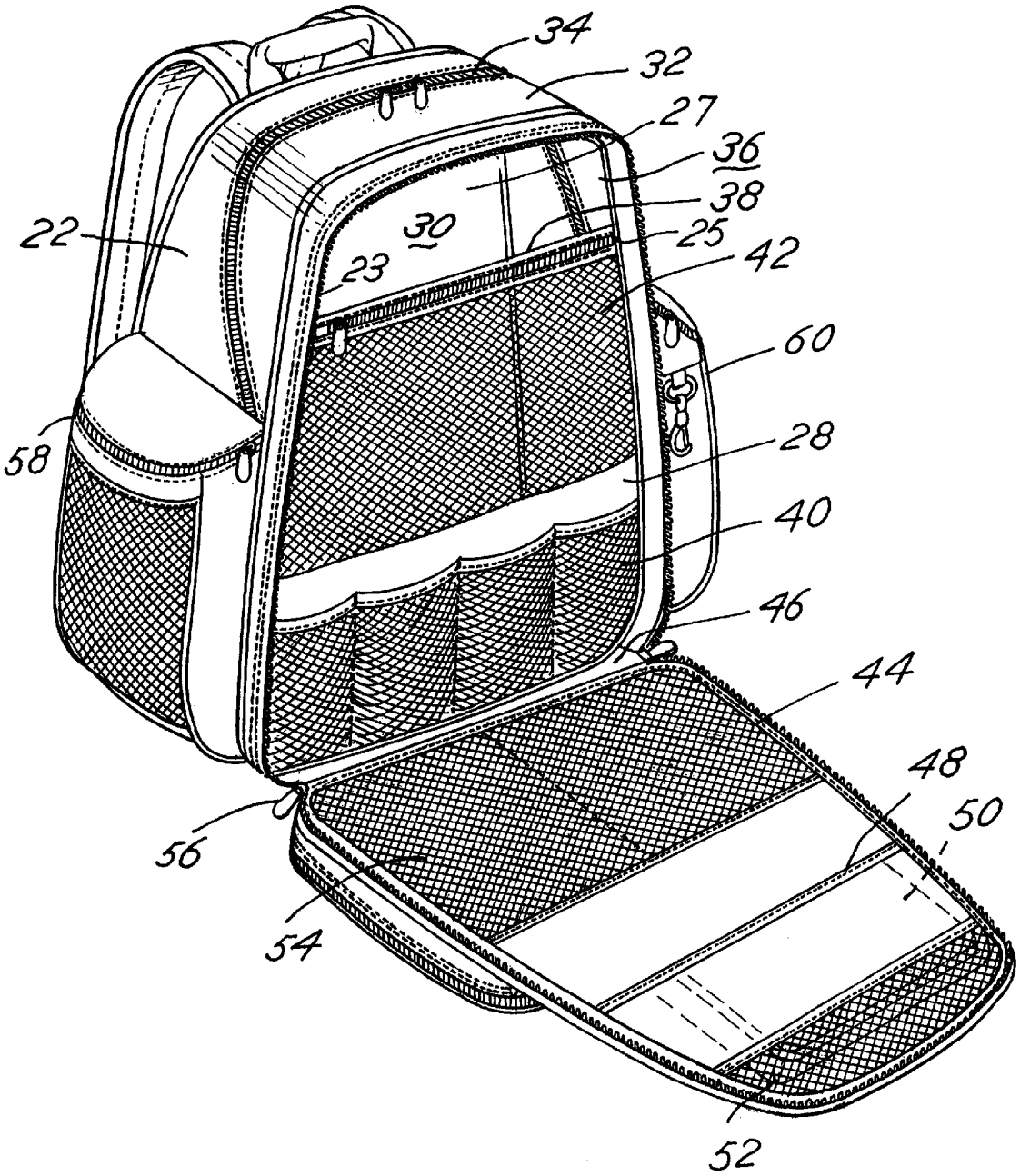
FIG. 4 is an isometric view of the backpack of FIG. 1 with the outer or second front panel flap in the open position.

The back panel 26 as shown in FIG. 2, has straps 62 and 64 attached thereto. The straps 62 and 64 are adjustable and as depicted in FIG. 3. A cushion 66 is preferably affixed to the back panel 26. The cushion 66 is concavely contoured to improve comfort during carriage of the backpack by placing the strap 62 and 64 over the shoulder and adjusting the position of the back panel 26 and more particularly the cushion 66 against the small of the back of user.

A separate carrier handle 68, is attached to the back panel 26. The position of the carrier handle 68 may be varied but is preferably attached to back panel 26 near juncture with top panel 32.

Figure 5:
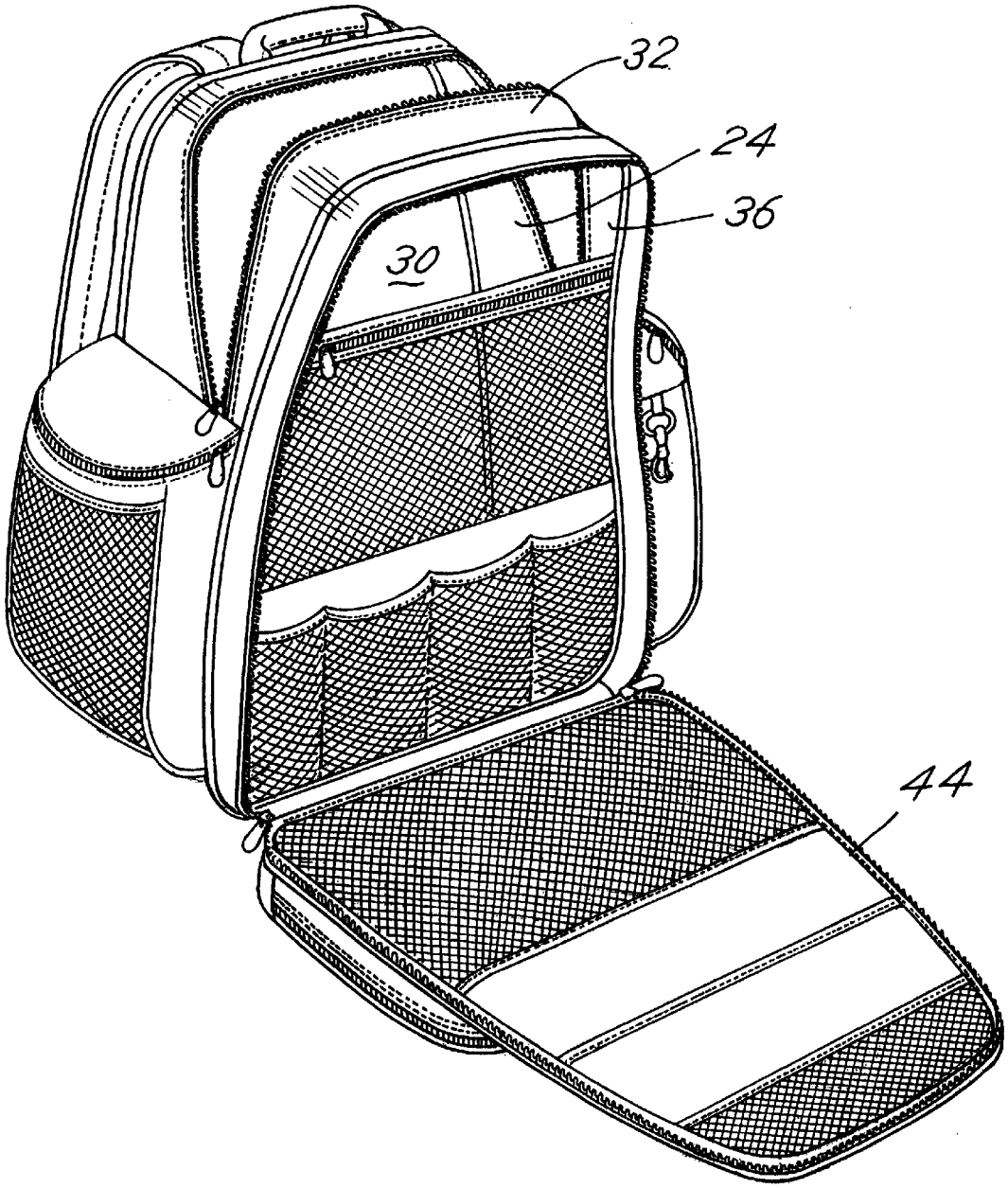
FIG. 5 is an isometric view of the backpack of FIG. 1 depicting the arrangement for access to the interior of the principal enclosure through the top of the backpack and via the open front panel flap.
Figure 6:
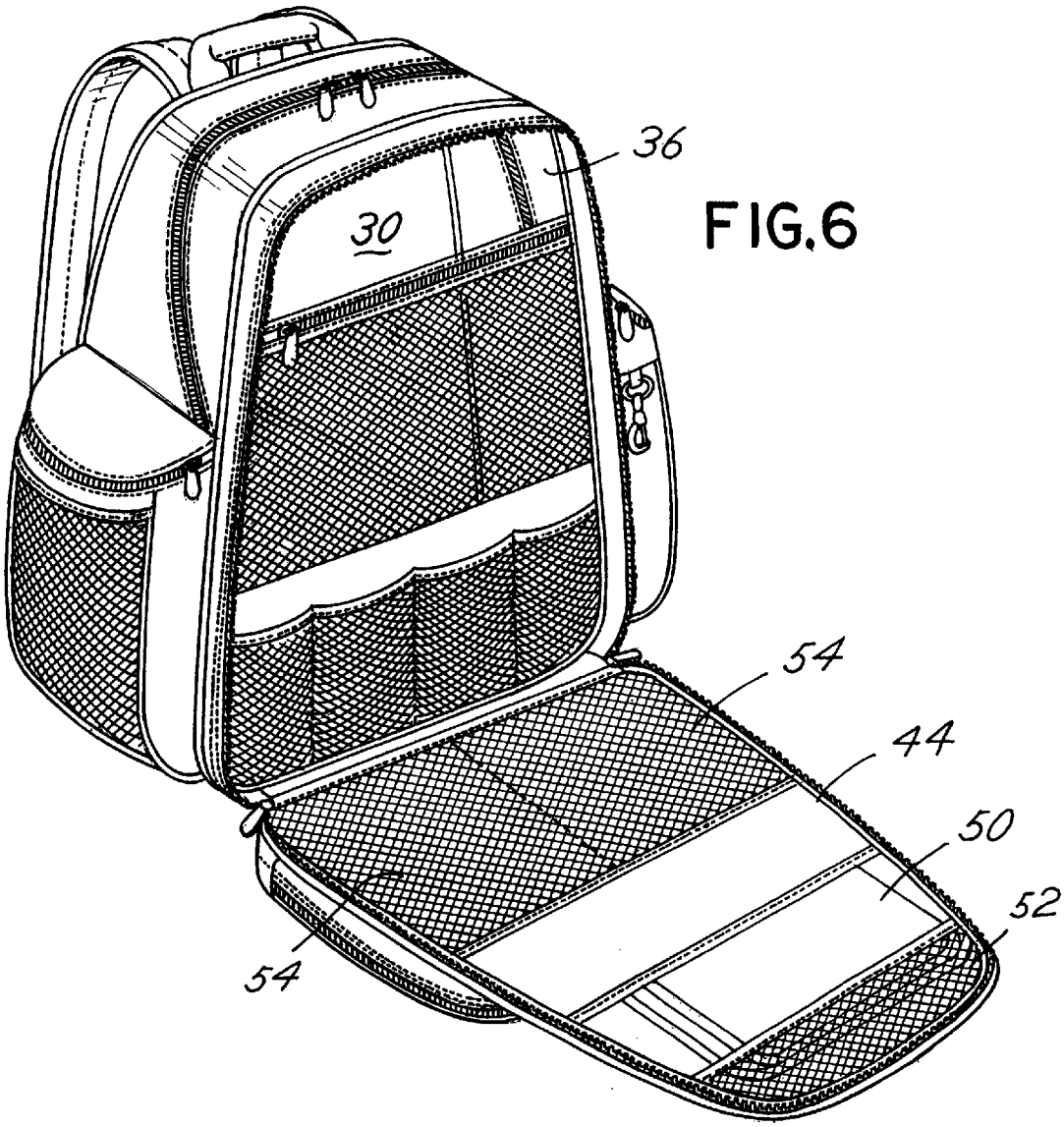
FIG. 6 is an isometric view of the backpack of FIG. 5 including an infant support pad stored in the front flap.

As depicted in FIG. 5, access to the enclosure 30 may be achieved then through the top panel 32 or through the opening 36 when the flap 44 is in the open position. This becomes especially important when certain uses are made of the knapsack construction. For example, as depicted in FIGS. 6, 7, 8, 9, and 10, when the knapsack is utilized and adapted for infant care, an infant support pad 50 is positioned in the front panel 44. That pad 50 may be removed and placed upon the flap 44 or used independently. In such a circumstance, ease of access to the interior 30 through opening 36 is provided since the flap 44 has been moved to the position depicted in FIG. 6 and the pad 50 has been removed for use.

Figure 7:
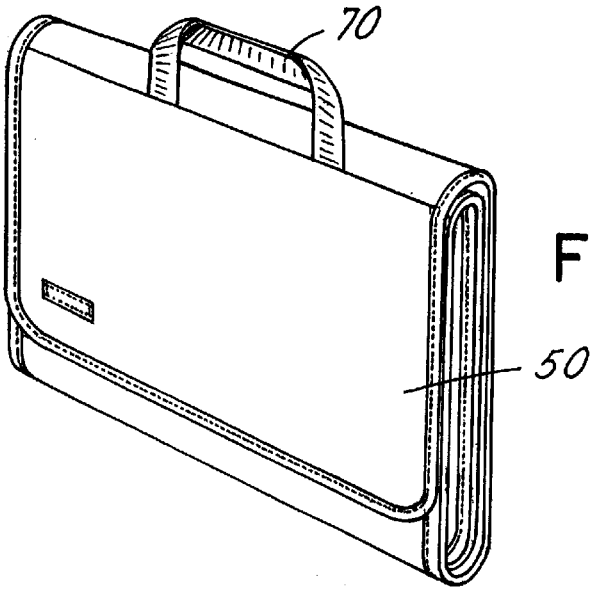
FIG. 7 is an isometric view of the infant support pad utilized in the backpack of FIG. 6.
Figure 8:
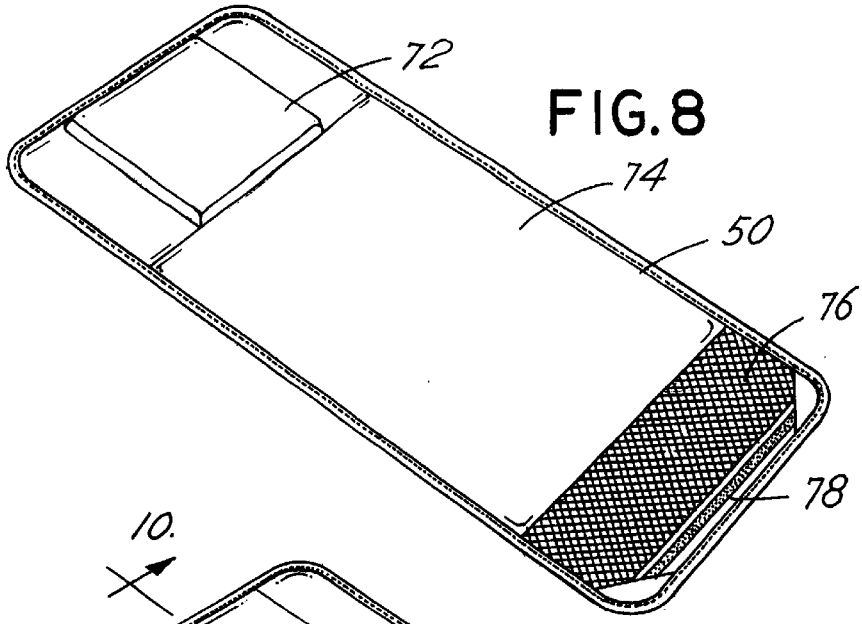
FIG. 8 is an isometric view of the infant support or changing pad depicted in FIG. 7 in the partially opened condition.
Figure 9:
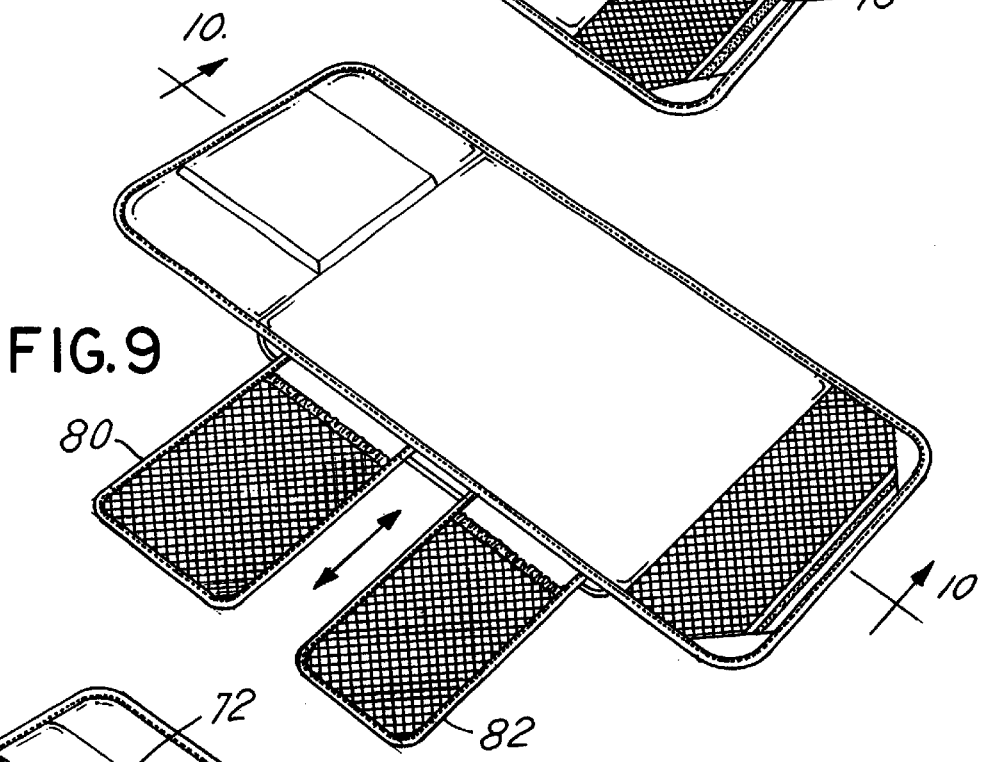
FIG. 9 is an isometric view of the infant changing pad of FIG. 8 in the fully opened position.
Figure 10:
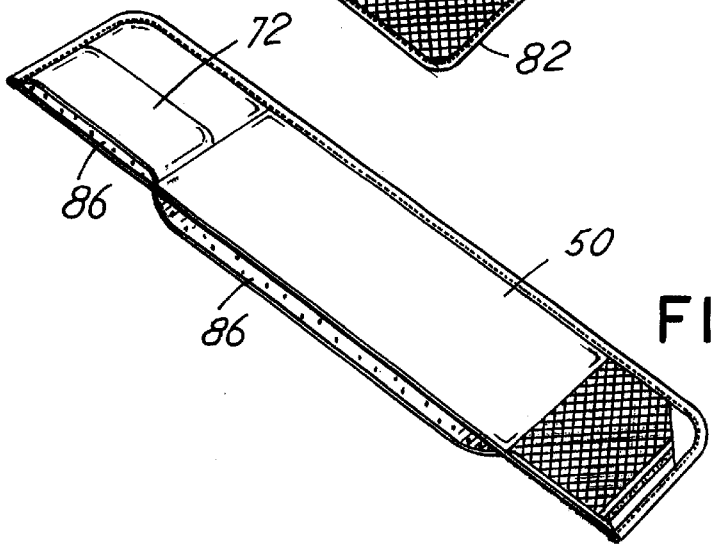
FIG. 10 is an isometric, cross-sectional view of the pad of FIG. 9 taken along taken along the line 10—10.

FIG. 7 depicts the construction of the pad 50 in the folded condition. The pad 50 includes a series of panels which may be folded together and retained by in the folded condition by fasteners. A handle 70 is provided for carriage of the folded pad 50. FIG. 8 depicts the pad 50 in the expanded or unfolded condition. The pad 50 includes a panel 72 for support of the head of an infant and a mid panel section 74 for support of an infant body. An elastic, zippered pocket 76 holds a blanket or other item in place. A fastener strip such as a Velcro fastener strip 78 may be provided along an edge of the pad 52 to hold it in the folded condition. As depicted in FIG. 9, auxiliary storage pockets 80 and 82 may be provided attached to the side edges of the pad 50 and may contain extra diapers that serve as padding since pockets 80, 82 slide in to openings in panel section 74. Importantly the pad 50 includes padding material. Open cell (soft) and closed (more rigid) cell foam 86 may be included in the main panel 74 as well as for the head 72. Preferably open cell material is provided in the head supporting panel 72.

With the embodiment depicted in FIGS. 1–10 therefore, all of the items necessary for care of an infant may be included in the backpack. The backpack may be adjustably carried on the back of an individual. Baby carriers of known construct may be utilized to carry the infant on the front of an individual. For example, front braces are now popular for carriage of infants on the front side of an individual. The combination of the backpack with such an arrangement facilitates ease of transport and care of an infant.

FIGS. 11 and 12 illustrate an alternative embodiment for carriage of a personal computer and business records, for example. In the embodiment of FIGS. 11 and 12, the backpack has substantially the same general construction including a second front panel or flap 90 which is congruent with a back panel 26. The pockets of the front panel 90 are adapted, however, for carriage of items for business purposes. Importantly a first front side panel 28 extends only partially upward from the base panel 20 in the same manner as described with regard to the embodiment of FIGS. 1–10. Again, the front panel 90 may be customized for storage of business items including a cell phone, writing instruments, etc.

As another important feature of the embodiment of FIGS. 11 and 12, there are provided retention flaps 92 and 94 extending from panel 28 and top 32 and which are connectable one with the other to facilitate retention of a personal computer 96 for example within the cushioned interior of the backpack. Side panel pockets 98 in the embodiment of FIGS. 11 and 12 can be customized for desired needs such as retention of a water bottle. Access to the interior 30 of the backpack of FIGS. 11 and 12 is achieved via the top panel 32 through a zippered opening 34. Access to the interior and the contents of the backpack may thus be achieved through the opening 34 as well as through the interior passage 36 through the interior of the backpack when panel 90 is opened. The construct of the embodiment of FIGS. 11 and 12 is otherwise substantially the same as that set forth with respect to FIGS. 1–10.

FIGS. 13 and 14 depict yet a further embodiment of the invention which is especially useful for craftsmen to carry tools and the like. In the embodiment of FIGS. 13 and 14 a back panel 100 is provided with carriage straps 102 and 104 attached thereto. A first side panel 104 is connected to the back panel 100. A spaced, second, lateral side panel 106 is also connected to the back panel 104. The back panel 100 as well as the lateral side panels 104 and 106 have the same height from a base panel. A front side panel 108 extends only partially upward from a base panel and connects to the edges of the lateral side panels 104 and 106 to define an open topped enclosure. A second front flap or panel 110 is provided which is generally congruent with the back panel 100 and which folds upwardly from the bottom to define a secondary enclosure. The principal enclosure is defined by the back panel 100, the side panels 104 and 106 as well as the front panel 108. Zippers along the sides 112 and 114 of the second front panel 110 attach that front panel 110 to the lateral side panels 104 and 106. Opening the front panel 110 is effected by detaching a top side flap 114, which comprises an extension of the back panel 100, from the straps 116 and 118 attaching that flap 114 to the second front panel 110. In this manner ease of access may be provided to the interior of the knapsack. Detaching the zipper connections 112 and 114 permits folding downwardly and outwardly of the front flap 110 for access to tools stored in that flap. Again, side pockets 120 and 122 may be provided for extra storage. Various pockets and retention features may be provided within the interior of the backpack also for tools and other items. Lowering the front panel or second flap 110 provides additional access to the interior of the backpack.

Various combinations and permutations of the arrangements described and depicted and are possible without departing from the spirit and scope of the invention. The invention is therefore to be limited only by the following claims and equivalents thereof.

What is claimed is:

1. A backpack comprising, in combination:

a base panel;

first and second laterally spaced, upwardly extending side panels affixed to the base panel;

a back panel extending upwardly at a height dimension from and affixed to the base panel and attached to the first and second side panels;

a first front panel affixed to and extending from the base panel at a juncture; said base panel, back panel, first front panel and side panels forming a storage enclosure with a topside having a top opening, the back panel and side panels extending a height equal to the maximum height dimension of the backpack;

back support straps attached to the back panel for carriage of the backpack with the top opening exposed upwardly; and a second front panel flexibly hinged to the base panel at the juncture of the front panel and base panel, said second front panel having opposite lateral sides, each lateral side releasably attached to one of said side panels, said second front panel generally congruent with said back panel and foldable from the first front panel downwardly and outwardly to provide an exposed flat inside panel face;

said first front panel extending from the base panel less than the height dimension of the back panel to thereby provide access to the storage enclosure.

2. The backpack of claim 1 wherein the second front panel includes an inside panel face, a pad assembly for an infant supported by said second front panel by the inside panel face.

3. The backpack of claim 1 wherein the second front panel includes an inside panel face having storage pockets.

4. The backpack of claim 1 wherein the backpack includes a top side panel with a fastener closure for access to the storage enclosure through the top side panel of the backpack.

5. The backpack of claim 1 further including at least one supplemental storage pocket on the outside of the first lateral side, the second lateral side or the second front panel.

6. The backpack of claim 2 where in the pad assembly includes a plurality of foldable padded panels foldable to form a folio generally congruent in shape with the second front panel and removable from the inside face of the second front panel.

7. The backpack of claim 1 including a handle along a top edge of the back panel.

8. The backpack of claim 4 including a fastener closure extending across the top side of the backpack and partially along each side panel.

9. The backpack of claim 1 further including a means for fastening the second front panel to the backpack said means for fastening extending continuously along a side edge of the first lateral side panel then connecting to the second lateral side panel and extending continuously along side edge of the second side panel.

10. The backpack of claim 2 or 6 wherein the infant pad includes a cushion foam panel for support of the head of an infant.

11. The backpack of claim 1 including detachable internal access flaps comprising an extension of the first front panel which are detachable for access to the storage opening.

* * * * *